United States Patent [19]

Deacon

[11] Patent Number: 4,470,657

[45] Date of Patent: Sep. 11, 1984

[54] CIRCUMFERENTIAL GROUNDING AND SHIELDING SPRING FOR AN ELECTRICAL CONNECTOR

[75] Inventor: George R. Deacon, Corona Del Mar, Calif.

[73] Assignee: International Telephone & Telegraph Corporation, New York, N.Y.

[21] Appl. No.: 366,547

[22] Filed: Apr. 8, 1982

[51] Int. Cl.[3] ..... H01R 13/658

[52] U.S. Cl. ..... 339/143 R; 339/14 R; 339/252 R

[58] Field of Search ..... 339/143 R, 147 R, 147 P, 339/14 R, 252 R, 252 P

[56] References Cited

U.S. PATENT DOCUMENTS

| | | | |
|---|---|---|---|
| 2,273,099 | 2/1942 | Gilbert | 112/119 |
| 3,278,885 | 11/1966 | Klinger | 339/60 |
| 3,366,918 | 1/1968 | Johnson | 339/143 |
| 3,466,590 | 9/1969 | Sylvester | 339/14 R |
| 3,521,222 | 7/1970 | Andrews | 339/143 R |
| 3,609,632 | 9/1971 | Vetter | 339/14 R |
| 3,678,445 | 7/1972 | Brancaleone | 339/143 R |
| 3,835,443 | 9/1974 | Arnold | 339/90 R |
| 4,106,839 | 8/1978 | Cooper | 339/143 R |
| 4,239,318 | 12/1980 | Schwartz | 339/143 R |
| 4,243,290 | 1/1981 | Williams | 339/143 R |
| 4,248,492 | 2/1981 | Snyder | 339/143 R X |
| 4,326,768 | 4/1982 | Punako | 339/143 R |
| 4,349,241 | 9/1982 | Juris et al. | 339/143 R |

*Primary Examiner*—Z. R. Bilinsky

*Attorney, Agent, or Firm*—T. E. Kristofferson; T. L. Peterson

[57] ABSTRACT

A substantially continuous "bracelet-like" grounding and electromagnetic shielding device for placement in a circumferential cavity formed by an annular groove in at least one of two overlapping body portions of mating electrical connector subassemblies. The device is formed as a flat stamping and curved into a "bracelet" shape with closely interleaving first and second axially extending flat fingers. A base portion in the form of a ring extending about the circumference of the groove and having a first set of substantially flat, integral, axially-extending fingers spaced circumferentially and occupying substantially the entire axial dimension of the cavity. A second set of similar fingers also integral with the base ring is folded against a surface of the base ring so as to extend in the same axial direction as the first finger set, the fingers of the first and second being tightly interleaved circumferentially and bowed radially outward at an axially intermediate point to facilitate electrical bonding between the mated connector subassemblies.

9 Claims, 6 Drawing Figures

CIRCUMFERENTIAL GROUNDING AND SHIELDING SPRING FOR AN ELECTRICAL CONNECTOR

DESCRIPTION OF THE PRIOR ART

The use of shielding in electrical connectors to eliminate unwanted radio frequency and electromagnetic signals (RFI/EMI) and electromagnetic pulses (EMP) from interfering with signals being carried by contacts in connectors is well known. U.S. Pat. Nos. 3,521,222; 3,678,445 and 4,106,839 disclose annular shields formed of sheet metal with spaced resilient fingers extending in the connector assembly axial (longitudinal) direction and formed to provide a spring connection between the mating halves of an electrical connector. The spring fingers of each such shield are spaced circumferentially from each other to provide open gaps so that substantial elimination of unwanted radio frequency and electromagnetic interference is not achieved. Another electrical connector shield which is well known in the art is formed from sheet metal and provided with alternating slots which open at opposite edges of the shield. The shield is expanded over the plug connector member and slightly compressed when the mating halves of the connector are inter-engaged. However, because the slots in the shield are open before the shield is mounted over the plug connector member, they remain open even after the connector halves are inter-engaged to compress the shield, thus leaving gaps which result in RFI, EMI and EMP leakage.

U.S. Pat. No. 3,835,443 discloses an electrical connector shield comprising a helically coiled conductive spring which is interposed between facing surfaces on the mating halves of a connector. The spring is coiled in such a manner that the convolutions thereof are slanted at an oblique angle to the center axis of the connector members. When the connector members are mated, the spring is axially flattened to minimize the gaps therebetween. However, as with the other prior art connectors discussed above, open gaps or windows still remain when the connector halves are fully mated.

U.S. Pat. No. 4,239,318 assigned to the assignee of the present application describes an electromagnetic shield for the same purpose as that of the invention. In that reference a spring band is interposed between the mating halves of the connector bodies in an annular cavity formed by a groove in one of the two connector body shells. That particular prior art device constituted an advance in the art, since it constituted an easily installed "expansion bracelet" reminiscent of the familiar wristwatch expansion band.

Any device of the type as described in U.S. Pat. No. 4,239,318 inherently includes the capability of being expanded for installation and therefore necessarily has openings to provide the mechanical strain relief required to accommodate the expandability. The result is that the electromagnetic shielding afforded is somewhat reduced. Furthermore, in view of the small diameters of many electrical connectors with which it is used, the shield itself is fabricated from quite thin sheet metal and is correspondingly delicate and difficult to fabricate.

Other prior art known to the Applicant consists of U.S. Pat. Nos. 3,366,918 and 4,243,290, neither of which discloses the invention.

The manner in which the invention further advances the art to which it relates will be evident as this description proceeds.

SUMMARY OF THE INVENTION

The apparatus of the invention comprises a substantially continuous "bracelet-like" electromagnetic shielding and grounding member for placement in a circumferential (annular) cavity formed by an annular groove in at least one of two overlapping body portions of mating electrical connector subassemblies. The device is formed from an initial flat stamping in which a plurality of flat finger-like projections extend laterally from either long dimension of a base portion, the fingers on one side of the base portion alternating so as to be opposite the spaces between fingers of the other side. One set of fingers is folded over the base portion so as to interleave closely with the fingers on the opposite side of the base portion, all of the fingers being bowed into a generally convex shape in axial cross-section to facilitate electrical bonding between mated conductive body shells as well as inhibition of radio frequency signals which would otherwise pass through the clearance space between these mated conductive body shell members.

A detailed description of a typical arrangement according to the invention will be hereinafter described.

DETAILED DESCRIPTION

Figure 1:
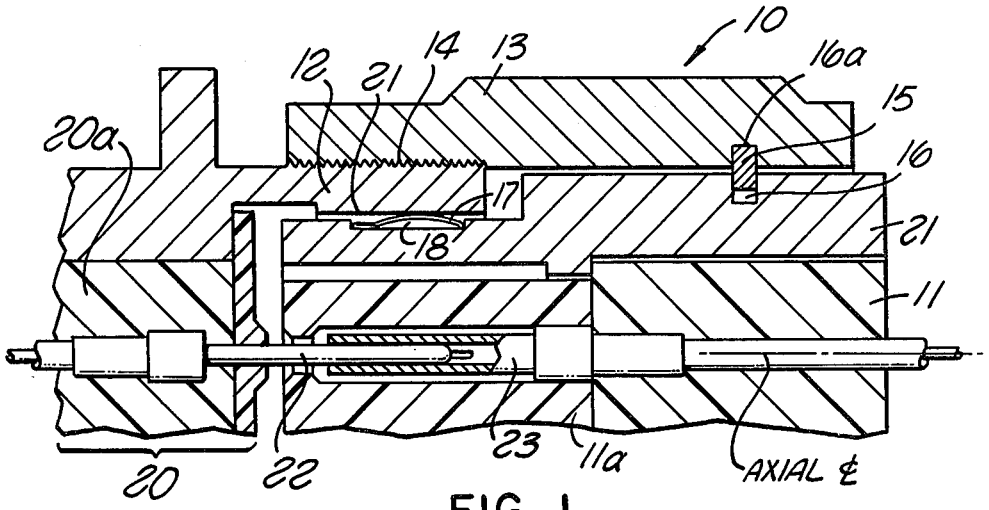
FIG. 1 is an axial cross-section of typical mated connector subassemblies showing the placement of the grounding and shielding spring of the invention.

Referring now to FIG. 1, an assembly of mated connector plug in receptacle subassemblies shown generally at 10. Although only a single electrical connection comprising the insertion of pin 22 into socket member 23 is illustrated, it will be understood that a plurality of such connections could be provided in the overall combination, that particular option being well understood in the prior art and comprising no part of the inventive concept per se.

The usual insulating inserts 11 and 11*a* in respect to the socket contact 23 and 20*a* in respect to the pin 22 are partially shown, although these are also entirely conventional. Still further, the body shell members 12 and 21 are secured in the mated position by the engagement ring 13 which is actually constrained (but with rotational freedom) by a lock ring 15 engaging grooves 16 and 16*a* in the respective members 21 and 13 as indicated. Accordingly, the threaded engagement at 14 provides for anchoring the connector subassemblies in the mated position or, alternatively, for releasing them for disconnection.

An annular (circumferential) groove 18 is provided within the thickness of the connector shell member 21, the grounding and shielding spring 17 fitting therein as shown.

Figure 2:
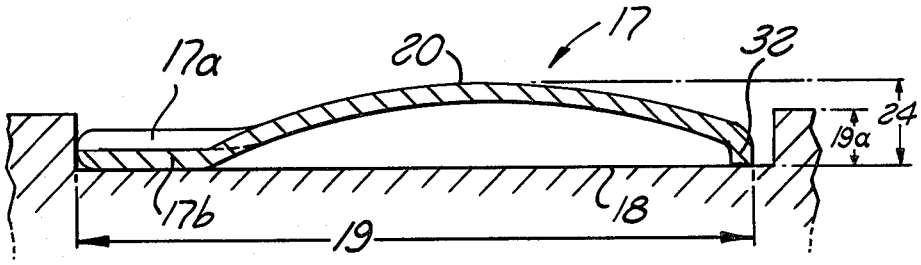
FIG. 2 is a magnified view of the shielding and grounding spring according to the invention in the same cross-sectional view as in FIG. 1.

Referring now also to FIG. 2, the device 17 of the invention is shown in magnified form for clarity. A radially outward bow is formed into the member 17 so that a crown or high spot 20 at some arbitrary axial location within the overall annular groove axial dimension 19 is provided. The member 17 being of resilient (spring) material lays firmly against the annular groove inner surface 18 and contacts the opposite surface 21 of body shell member 12. This effect results from the fact that the uncompressed radial bow dimension 24 is greater than the radial depth of the circumferential groove, this step being illustrated at 19*a* in FIG. 2.

A suitable material for the fabrication of the spring member 17 may be selected from the known array of spring materials commercially available. Most often, a material such as beryllium copper provides satisfactory characteristics, although a less costly spring material might be considered if overall cost considerations dictate such a choice. The member 17 may be plated with a material which restricts corrosion and also reduces the dissimilar metals problem between the body shell parts, which are customarily fabricated from an alluminum alloy, and the base metal of the member 17.

Figure 3:
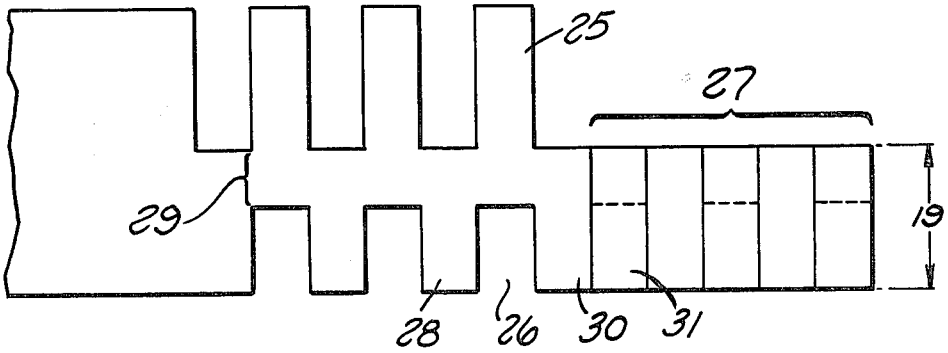
FIG. 3 is a flat stamping according to a first step in the manufacture of the device according to the invention showing a portion of the flat fingers folded over according to a second step in the manufacture.

Referring now to FIG. 3, illustrates how a blank, formed in a punch press for example, can be very economically produced as a first step in a production of the member 17 according to the invention. It will be seen that a typical flat finger 25 is of sufficient length so that when folded over (toward the bottom of FIG. 3) occupies the space 26 fully. By fully occupying the space 26, it is of course meant that the clearance between adjacent fingers is as close to zero as is mechanically practical. Thus, the clearance between the FIG. 25 when folded into the space 26 between adjacent fingers 28 and 30, for example, is negligible. At 27 on FIG. 3 some of the longer fingers folded into place are illustrated, typically 31, which of course was folded from a position equivalent to that of 25. The net final dimension 19 is illustrated and relates to FIG. 2.

In FIG. 3 it has been assumed that the nose at 32 in FIG. 2 has not yet been downwardly formed in the showing of FIG. 3.

From an understanding of the foregoing, it will be realized that the metal working or forming processes involved are all conventional and well known to those of skill in this art.

Figure 4:
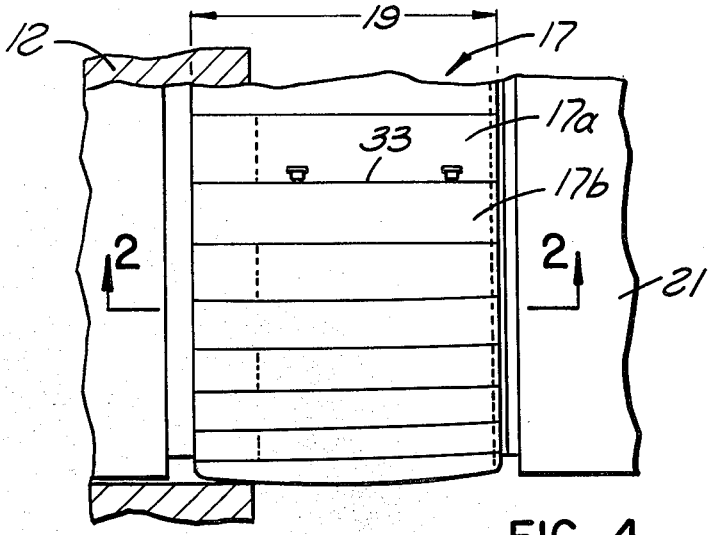
FIG. 4 illustrates a radial view of the grounding and shielding spring as placed according to FIG. 1.

Referring now to FIG. 4, a radially inward view is shown, i.e., that which would be seen looking radially inward (down from the top on FIG. 1) with the receptacle body shell 21 separated from the engagement illustrated in FIG. 1.

In FIG. 4 the flat but folded and completely formed member as in the portion 27 of FIG. 3 has been placed in the annual groove 18 of connector body shell 21. If it is assumed that 33 represents an interface line, i.e., where the two wrapped-around ends of the flat formed member join, it will be realized that some method of attachment is required. Of course, hard soldering can be employed, or attachments according to FIG. 5*a* or 5*b* can be effected. These attachments will be familiar to those of skill in this art or in any of the sheet metal working arts.

Figure 5A:
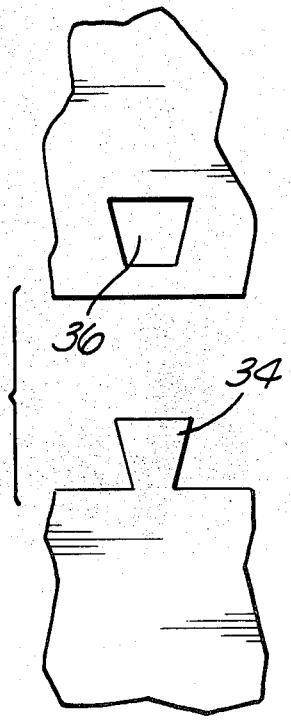
FIGS. 5*a* and 5*b* illustrate alternative mechanical joining expedients in accordance with which the butted circumferential interface of the device may be secured with the device in place.
Figure 5B:
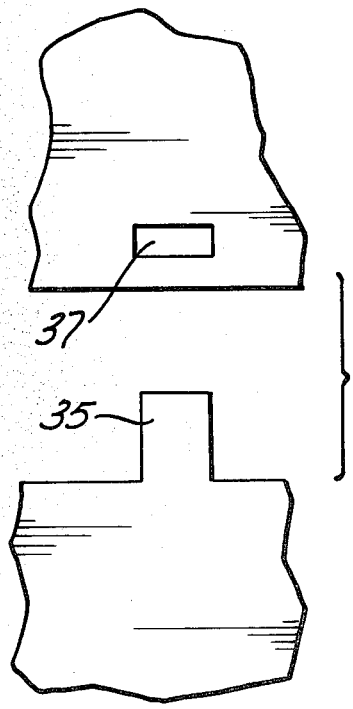

FIGS. 5*a* and 5*b*, one of the tongues 34 or 35 is fitted into a slot 36 or 37, respectively, and crimped over, with or without subsequent soft or hard soldering.

Referring back to FIG. 3, the portion dimension 29 constitutes a ring or base when the member is wrapped around as in FIG. 4, and accordingly, additional circumferential attachment can be provided where the ends of this ring portion abut along the interface line 33.

The installed member 17 according to the invention may be tightly drawn together so that it is not easily rotatable within the annular groove 18, or it may be somewhat more loosely attached allowing for re-seating each time the connector subassemblies are mated.

From the foregoing, it will be understood that an inexpensively fabricated shield member is provided, which is much "tighter" i.e., free of the gaps and openings typical of prior art devices which preclude optimum shielding against passage of electromagnetic energy in the gap between the mated body shells. Grounding or bonding between the mated connector body shells, i.e., between surfaces 18 and 21 as indicated in FIG. 1 is also effectively provided.

Certain modifications and variations will of course suggest themselves to those of skill in this art once the concepts of the invention are fully appreciated. For just one example, the bowing of the fingers resulting in a high point at 20 as shown on FIG. 2 could be shaped differently so that the high point is elsewhere within the dimension 19. Other methods of effecting the butt attachment discussed in connection with FIGS. 4, 5*a* and 5*b* are of course available, the main object in this connection being the tightness of the interface line 33 after assembly as in FIG. 4 in the absence of openings permissive of signal energy passage at the location of the shielding and grounding spring.

What is claimed is:

1. A combination shielding and grounding device formed from resilient conductive sheet material for installation in an annular groove of predetermined axial dimension within overlapping conductive body portions of a pair of mating electrical connector subassemblies, comprising:

a ring portion adapted to extend substantially continuously about the circumference of said groove, said ring portion having an axial dimension less than said groove axial dimension, said ring portion having opposite edges;

a first set of spaced fingers integral with one of said edges of said ring portion and extending axially therefrom; and a second set of spaced fingers integral with the other of said edges of said ring portion and folded substantially 180° against said ring portion so as to extend axially in the same direction as said fingers of said first set, said fingers of said first set being spaced apart a distance only slightly greater than the width of the fingers of said second set, said first and second finger sets interleaving to minimize the circumferential clearance between adjacent fingers to form a continuous bracelet, said fingers being bowed in axial cross-section whereby the fingers are adapted to contact radially opposite surfaces of said body portions of said mating electrical connector subassemblies.

2. The invention device according to claim 1 in which said bracelet is of conductive spring metal.

3. The device according to claim 1 in which said ring portion is fabricated as a strip with its ends joined to form said bracelet.

4. The device according to claim 1 in which said fingers of said second finger set are folded in a radially outward relationship with respect to said ring portion and are bowed to substantially the same curvature as said fingers of said first set as they extend axially from said ring portion.

5. An electrical connector comprising:

a pair of mating electrical connector members having telescopically assembled conductive shells providing adjacent circumferential surfaces;

a continuous groove of predetermined axial dimension in one of said surfaces; and a shielding and grounding device mounted in said groove, said device comprising:

a ring portion extending substantially continuously around said groove, said ring portion having an axial dimension less than said predetermined axial dimension, said ring portion having opposite edges;

a first set of spaced fingers integral with one of said edges of said ring portion and extending axially therefrom within said groove; and a second set of spaced fingers integral with the other of said edges of said ring portion and folded substantially 180° against said ring portion so as to extend axially in the same direction as said fingers of said first set, said fingers of said first set being spaced apart a distance only slightly greater than the width of the fingers in said second set, said first and second finger sets interleaving to minimize the circumferential clearance between adjacant fingers to form a continuous bracelet within said groove, said fingers engaging said circumferential surfaces of said shells.

6. A device according to claim 5 in which said ring portion is in electrical contact with the bottom of said groove and substantially adjacent to one axial end of said groove, said fingers extending substantially to the other axial end of said groove, said fingers being bowed thereby producing a point of contact against the other of said surfaces at a location intermediate between said axial ends.

7. An electrical connector comprising:

a pair of mating electrical connector members having telescopically assembled conductive shells providing adjacent circumferential inner and outer surfaces;

a continuous circumferential groove in said outer surface; and a shielding and grounding device mounted in said groove, said device comprising:

a ring portion in said groove, said ring portion having opposite circumferential edges;

a plurality of integral, resilient fingers extending axially in the same direction in said groove from said ring portion, said fingers being immediately adjacent to each other so that there is essentially no space between said fingers;

alternative ones of said fingers being joined to one of said edges while the remaining fingers are joined to the other of said edges;

said fingers electrically engaging said outer surface.

8. A connector as set forth in claim 7 wherein:

said ring portion is cylindrical; and said remaining fingers are folded substantially 180° relative to said ring portion so as to overlap said ring portion.

9. A connector as set forth in claim 8 wherein:

said fingers are bowed outwardly at a location spaced axially from said ring portion for engaging said inner surface.

* * * * *